US010858895B2

(12) United States Patent
Dinica et al.

(10) Patent No.: US 10,858,895 B2
(45) Date of Patent: Dec. 8, 2020

(54) AXIAL, LATERAL AND TORSIONAL FORCE DAMPENER

(71) Applicant: QCD Technology Inc., Calgary (CA)

(72) Inventors: Cornel Dinica, Calgary (CA); Anthony Desmond Russell, Okotoks (CA); Denice Monteil, Calgary (CA)

(73) Assignee: QCD Technology Inc., Calgary (CA)

( * ) Notice: Subject to any disclaimer, the term of this patent is extended or adjusted under 35 U.S.C. 154(b) by 836 days.

(21) Appl. No.: 14/766,631

(22) PCT Filed: Feb. 6, 2014

(86) PCT No.: PCT/CA2014/000089

§ 371 (c)(1),
(2) Date: Aug. 7, 2015

(87) PCT Pub. No.: WO2014/121377

PCT Pub. Date: Aug. 14, 2014

(65) Prior Publication Data

US 2015/0376959 A1 Dec. 31, 2015

Related U.S. Application Data

(60) Provisional application No. 61/762,737, filed on Feb. 8, 2013.

(51) Int. Cl.
*E21B 17/07* (2006.01)

(52) U.S. Cl.
CPC ..... *E21B 17/07* (2013.01)

(58) Field of Classification Search
CPC ..... E21B 17/07
USPC ..... 277/512, 515
See application file for complete search history.

(56) References Cited

U.S. PATENT DOCUMENTS 2,822,050 A * 2/1958 Conrad ..... E21B 33/1275 277/333
2,897,016 A * 7/1959 Baker ..... E21B 17/105 175/325.6
3,306,078 A 2/1967 Hughes
3,406,537 A 10/1968 Falkner, Jr.
3,581,834 A * 6/1971 Kellner ..... E21B 17/07 175/321
3,871,193 A 3/1975 Young
(Continued)

FOREIGN PATENT DOCUMENTS

WO 2014022768 A 2/2014

*Primary Examiner* — Waseem Moorad
*Assistant Examiner* — Neel Girish Patel
(74) *Attorney, Agent, or Firm* — St. Onge Steward Johnston & Reens LLC

(57) ABSTRACT

A downhole tool for dampening vibrational, lateral, compressive, and tensile forces within a drillstring is described. The downhole tool generally includes a bottom end shaft configurable to a drillstring and that is telescopically engaged within a compression housing and a torsional housing. The torsional housing enables the bottom end shaft to slide axially with respect to the torsional housing whilst preventing torsional movement of the bottom end shaft relative to the torsional housing. The compression housing is configurable to drillstring equipment and operatively contains a first spring between the compression housing and the bottom end shaft that absorbs compression forces between bottom end shaft and compression housing.

24 Claims, 16 Drawing Sheets

(56) References Cited

U.S. PATENT DOCUMENTS 4,257,245 A 3/1981 Toelke et al.
4,434,863 A 3/1984 Garrett
4,997,037 A * 3/1991 Coston ..... E21B 17/07 166/105
5,048,611 A * 9/1991 Cochran ..... E21B 21/103 166/374
5,083,623 A 1/1992 Barrington
5,251,914 A * 10/1993 Tatum ..... E21B 10/25 175/371
6,062,905 A * 5/2000 Sampa ..... E21B 23/08 439/587
6,269,878 B1 * 8/2001 Wyatt ..... E21B 23/06 166/142
8,205,691 B2 6/2012 Bowar et al.
10,407,999 B2 * 9/2019 Pratt ..... E21B 47/017
2002/0050361 A1 * 5/2002 Shaw ..... E21B 43/128 166/380
2002/0185312 A1 * 12/2002 Armell ..... E21B 4/10 175/19
2003/0089497 A1 * 5/2003 George ..... E21B 17/07 166/297
2003/0102164 A1 * 6/2003 Odell, II ..... E21B 17/07 175/57
2005/0279565 A1 * 12/2005 Arian ..... E21B 47/16 181/121
2009/0023502 A1 1/2009 Koger
2009/0173541 A1 * 7/2009 Tulloch ..... E21B 7/04 175/45
2011/0198126 A1 * 8/2011 Swietlik ..... E21B 17/07 175/55
2012/0152518 A1 * 6/2012 Johanning ..... E21B 47/017 166/65.1
2012/0211251 A1 * 8/2012 Konschuh ..... E21B 28/00 173/201
2012/0228028 A1 9/2012 Turner et al.
2012/0247832 A1 10/2012 Cramer et al.
2017/0328142 A1 * 11/2017 Pratt ..... E21B 47/017

* cited by examiner

TOOL IN FULL EXTENSION

TOOL IN BALANCE

TOOL IN FULL COMPRESSION

AXIAL, LATERAL AND TORSIONAL FORCE DAMPENER

FIELD OF THE INVENTION

The invention relates to systems for dampening axial, lateral and torsional forces to probe-based sensors within a drillstring.

BACKGROUND OF THE INVENTION

In the oil and gas industry and in particular during directional drilling, measurement while drilling (MWD), logging while drilling (LWD) and logging while tripping (LWT) procedures, there is a need to protect downhole equipment from the high shock downhole environment during these drilling procedures. In particular, during these procedures, as sensitive downhole equipment may form part of the drill string, there is a need to protect the equipment from the severe torsional, axial and lateral vibrations and shock experienced by the equipment as the drillstring is moved up and down and rotated within the well.

As is known, such equipment may include electronic devices that include various sensors and on-board electronics that are designed to obtain and collect data from the well. Generally, such devices are engineered to withstand particular stress loadings; however, as with all equipment there are limits as to what the equipment can withstand.

For example, in the particular case of techniques such as MWD and horizontal drilling, such techniques often require and/or utilize drillstring agitation devices that are activated to enable desired rates of penetration (ROP). As such, measurement equipment may be more susceptible to damage due to increased shock and vibrational loads.

Moreover, in the particular case of horizontal drilling, severe torsional stresses can be imposed on a drill string as a result of the friction of a long section of stationary drill pipe lying against a lower surface of a well. That is, during drilling of deviated sections, a drill string may "wound up" as rotation of the drill string commences and the frictional forces of the drill string against the well have to be overcome before rotation of the drill string occurs. In these cases, there can be a violent release of torsional energy at the moment these frictional forces are overcome that can impart severe stresses on any sensors located within the drill string.

As a result, the severe forces being applied to the various pieces of equipment can often result in early or unexpected failures of equipment. Moreover, as drilling technologies and methodologies evolve, equipment may be subjected to greater forces.

As is well known, equipment failures are expensive to operators both from a time and cost perspective.

In the past, various technologies have been developed to address these problems and while some of these past technologies have been at least partially effective in addressing some of the above issues, there continues to be a need for technologies that are effective in providing a unified solution to dampening axial, lateral and torsional forces while also enabling throughbore pressures to be maintained within the drillstring, and maintain alignment integrity.

For example, various collar based solutions have been provided in the past. However, collar based systems often add 2.5 m to the overall length of the sensing package, are difficult to service, and can be difficult to achieve compatibility with existing equipment. As well, certain variations of collar based systems absorb energy in the collars, which degrades ROP. Also, this technology has been known to interfere with the drilling dynamics.

Other force dampening systems include the use of snubbers. Snubbers are sets of pins that are attached to printed circuit board (PCB) carriers, which are then encapsulated in rubber. The rubber is then is encapsulated in a metal shell that is attached to a housing that the PCB carrier is contained in. As such, snubbers are designed to isolate the PCB boards from the shock and vibration experienced by the PCB housing. However, while snubbers are at least partially effective, as drilling shock and vibration loads are generally increasing within the industry, snubbers are destroyed more quickly.

A review of the prior art reveals that various tools to have been developed in the past. Examples of these tools include those described in Patent References US 2012/0228028, US 2012/0152518, US 2012/0247832, US 2009/0023502, US 2011/0198126, U.S. Pat. Nos. 3,406,537, 3,306,078 and 5,083,623.

In view of the above, there has been a need for improved anti-vibrational tools that provide anti-rotational properties and throughbore pressure integrity. In addition, there has been a need for improved anti-vibrational tools capable of withstanding 150-175 g loads and that have improved assembly and maintenance properties in a compact design.

SUMMARY OF THE INVENTION

In accordance with the invention, there is provided a downhole tool for dampening compressive and tensile forces within a drillstring comprising: a bottom end shaft configurable to a drillstring, the bottom end shaft telescopically engaged within a compression housing and a torsional housing; the torsional housing having at least one longitudinal slot operatively containing at least one pin for sliding engagement within a corresponding longitudinal slot and engagement within a recess on the bottom end shaft, wherein engagement of each pin within each longitudinal slot allows axial movement of the bottom end shaft relative to the torsional housing and prevents rotational movement of the bottom end shaft relative to the torsional housing; the compression housing configurable to drillstring equipment, the compression housing operatively containing a first spring between the compression housing and the bottom end shaft, the first spring for absorbing compression forces between the bottom end shaft and the compression housing.

In another embodiment, the tool includes a second spring operatively contained within the compression housing between the compression housing and the bottom end shaft, the second spring for absorbing tension forces between the bottom end shaft and the compression housing and wherein when under no compressive or tensile forces the first and second springs return the bottom end shaft to a balanced position.

In another embodiment, the torsional housing includes a rubber insert configured to the inner surfaces and wherein the at least one pins engage with the rubber insert. In a preferred embodiment, the torsional housing retains four pins.

In yet another embodiment, the first and second springs are contained within first and second hydraulic chambers containing hydraulic fluid.

In preferred embodiments, the tool includes a plurality of seals including a first seal operatively connected between the torsional housing and bottom end shaft and a second seal operatively connected between the compression housing and bottom end shaft.

In another embodiment, the tool includes a pressure compensation system for equalizing pressure between the exterior of the tool and the first and second seals. In a more specific embodiment, the pressure compensation system includes a pressure ring operatively positioned between the first and second seals having an internal diameter generally corresponding to the external diameter of the bottom end shaft, the pressure ring having at least one hole extending between an internal and external surface of the pressure ring and wherein the external surface operatively retains a pressure ring seal.

In another embodiment, the torsional housing comprises an outer torsion housing and an inner torsion cartridge and wherein the inner torsion cartridge has at least one longitudinal slot operatively containing at least one pin for sliding engagement within a corresponding longitudinal slot and engagement within a recess on the bottom end shaft and wherein the inner torsion cartridge and outer torsion housing have mating splines and recesses enabling helical and axial movement of the inner torsion cartridge relative to the outer torsion housing when the inner torsion cartridge is subjected to a torsional force relative to the outer torsion housing. In this embodiment, the system will preferably include a disk spring seated against downhole and uphole surfaces of the inner torsion cartridge for absorbing axial uphole and downhole forces when the inner torsion cartridge moves relative to the outer torsion housing.

BRIEF DESCRIPTION OF THE DRAWINGS

The invention is described with reference to the accompanying figures in which.

DETAILED DESCRIPTION OF THE INVENTION

With reference to the figures, an axial, lateral and torsional force dampener (ALTFD) 10 is described. The ALTFD is configurable to a drillstring and is generally capable of dampening the highly destructive shock and vibrations within a drillstring to protect electronic sensing equipment inside the drillstring.

Figure 13:
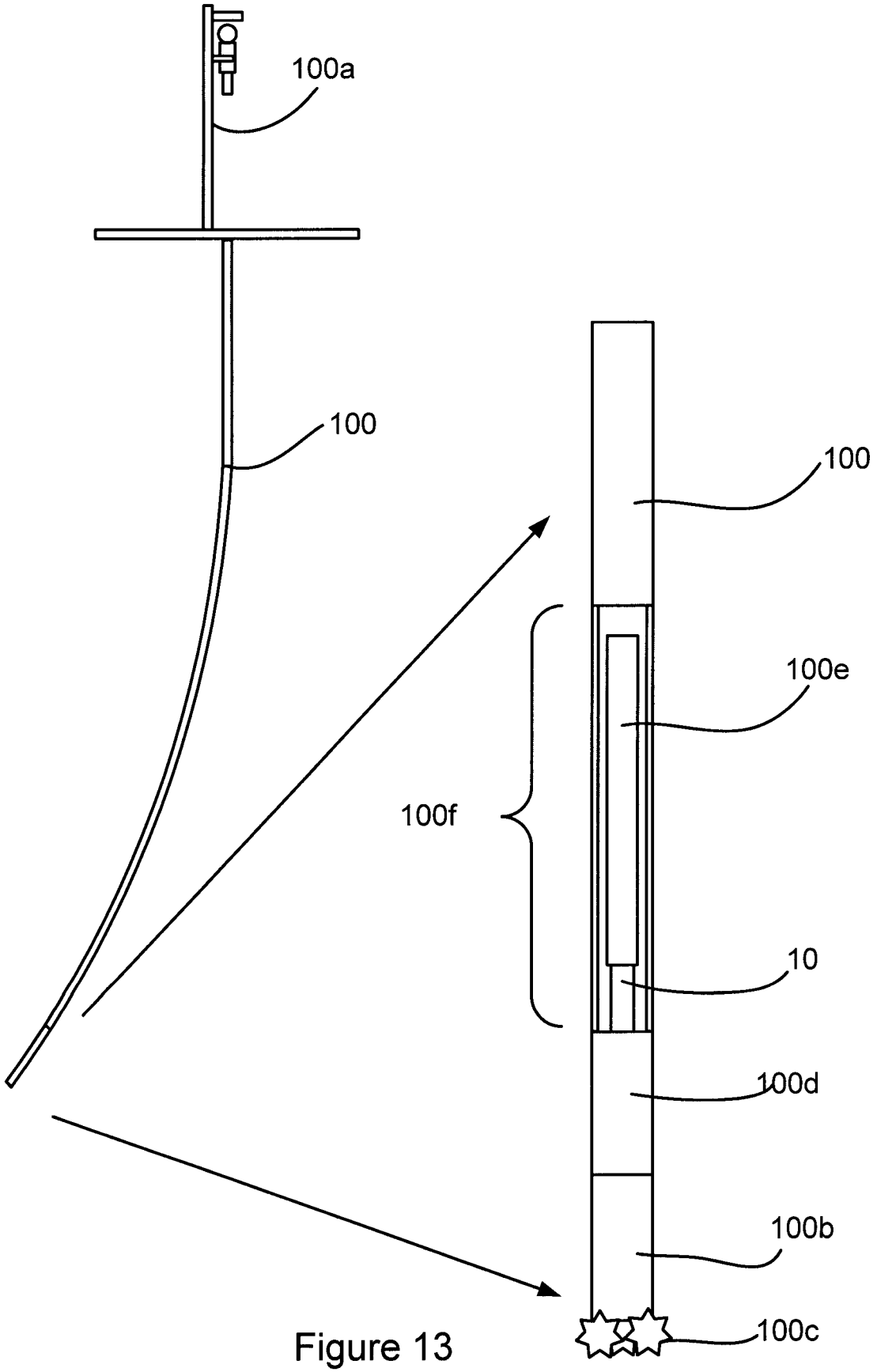
FIG. 13 is a schematic diagram of an axial and torsional force dampener configured to a drill string in accordance with one embodiment of the invention.

The ALTFD is generally adapted for connection to a drillstring 100 as shown in FIG. 13. As shown, the drillstring 100 is raised and lowered relative to a surface drilling rig 100*a* that controls a downhole drilling process. At the end of the drillstring, the drillstring is connected to a drilling motor or bit sub 100*b* and drillbit 100*c*. Uphole of the drilling motor, the drillstring includes a landing sub 100*d* configured to receive equipment for evaluating the formation. The ALTFD 10 and sensor equipment 100*e* are connected to the landing sub 100*d* such that the ALTFD is positioned between the landing sub 100*d* and all sensor equipment 100*e*. The drillstring 100 is shown as a cutaway 100*f* to show the ALTFD 10 and sensor equipment 100*e* inside the drill string 100 in FIG. 13.

ALTFD Overview

The ALTFD 10 generally includes a lower end shaft 12, compression housing 14, mid-bulkhead 16, pin housing 18 and bottom stopper 20 that comprise the primary structural components of the ALTFD and that operatively contain other components of the system. The ALTFD is a pressure compensated, sealed and internally lubricated system. The foregoing components generally enable telescopic extension and compression of the lower end shaft 12 with respect to compression housing 14 whilst simultaneously enabling torsional force to be applied between the lower end shaft 12 and the compression housing 14 whilst allowing the telescopic extension and compression.

Figure 2:
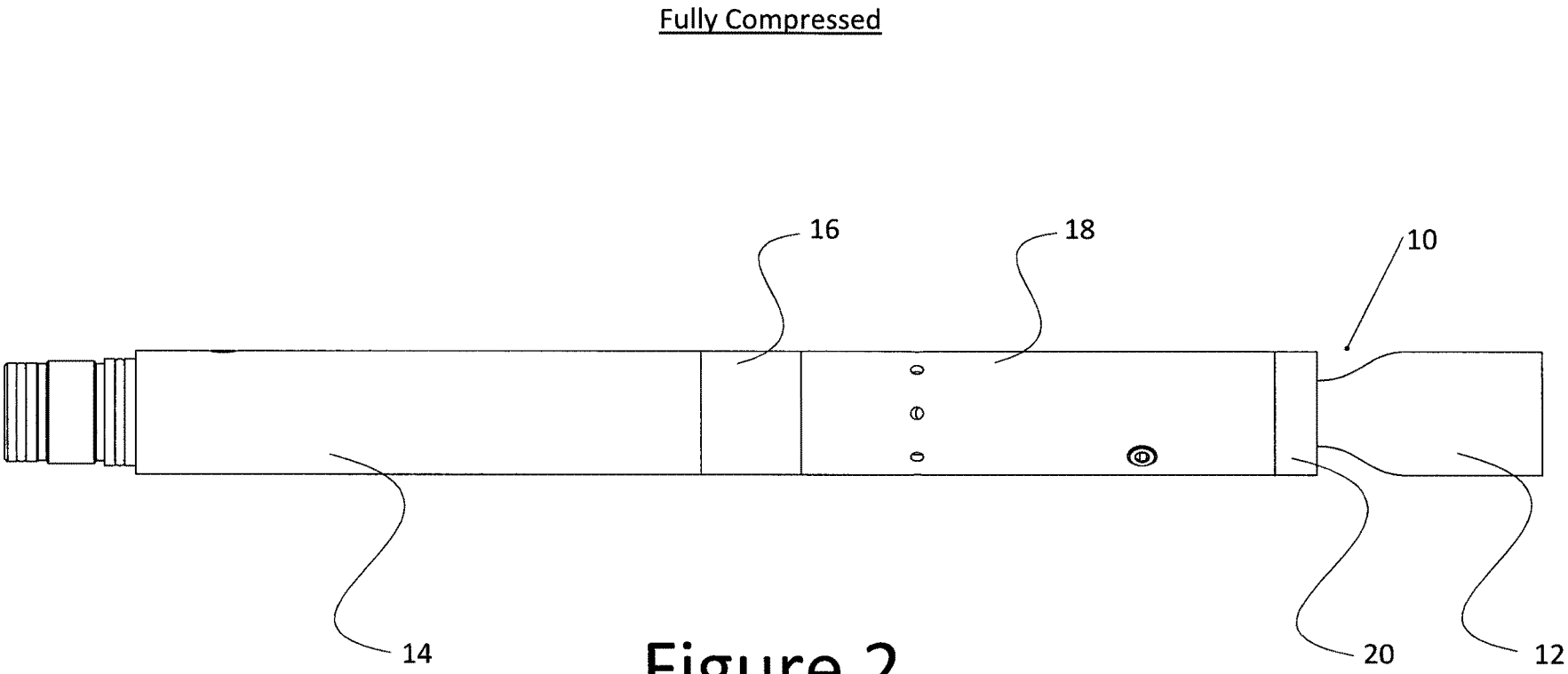
FIG. 2 is an assembled perspective diagram of an axial and torsional force dampener in a compressed position in accordance with one embodiment of the invention.
Figure 3:
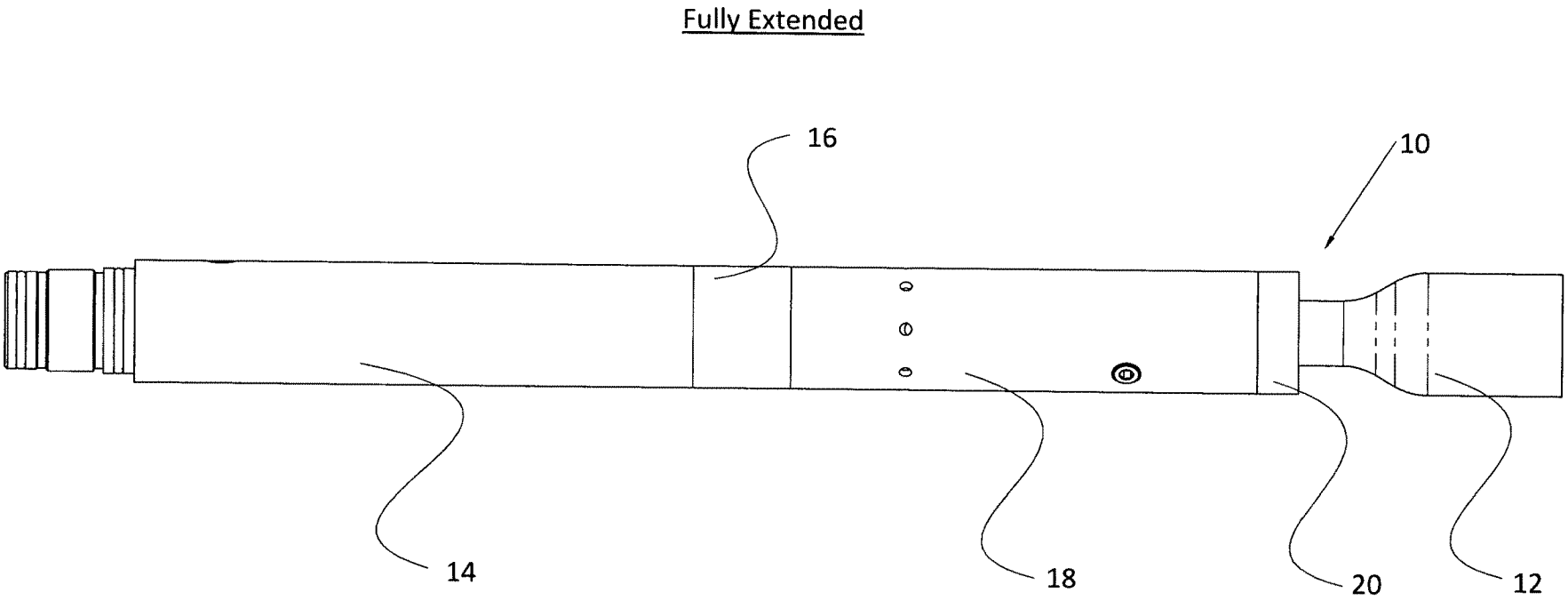
FIG. 3 is an assembled perspective diagram of an axial and torsional force dampener in an extended position in accordance with one embodiment of the invention.
Figure 4:
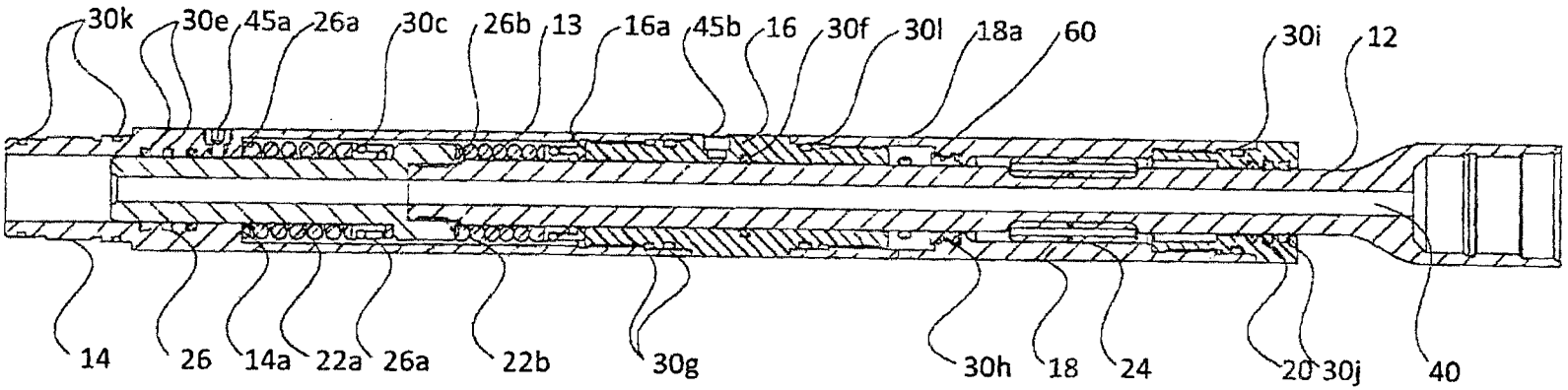
FIG. 4 is an assembled cross-sectional diagram of an axial and torsional force dampener in a fully-extended position in accordance with one embodiment of the invention.
Figure 5:
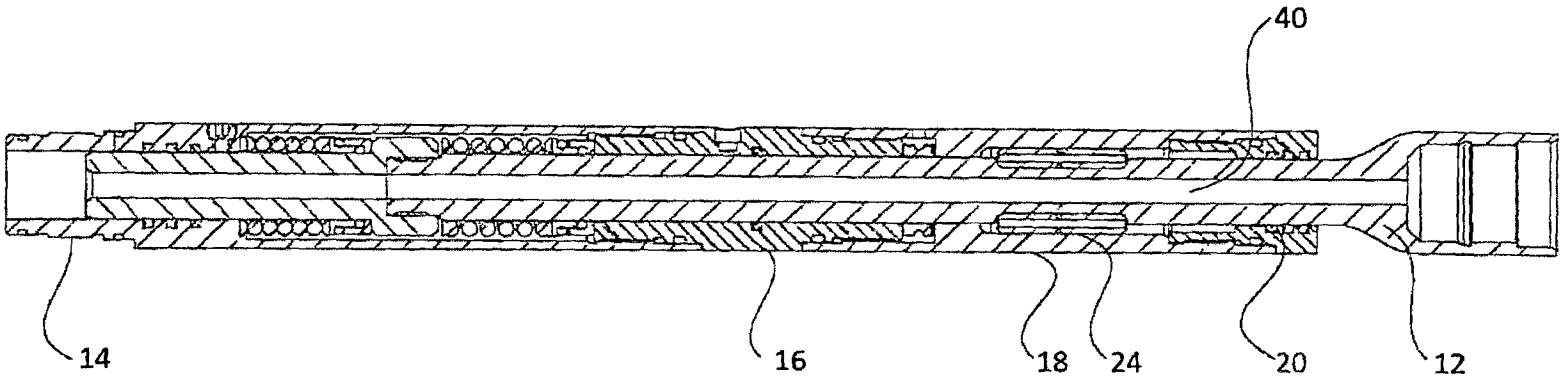
FIG. 5 is an assembled cross-sectional diagram of an axial and torsional force dampener in a balanced position in accordance with one embodiment of the invention.
Figure 6:
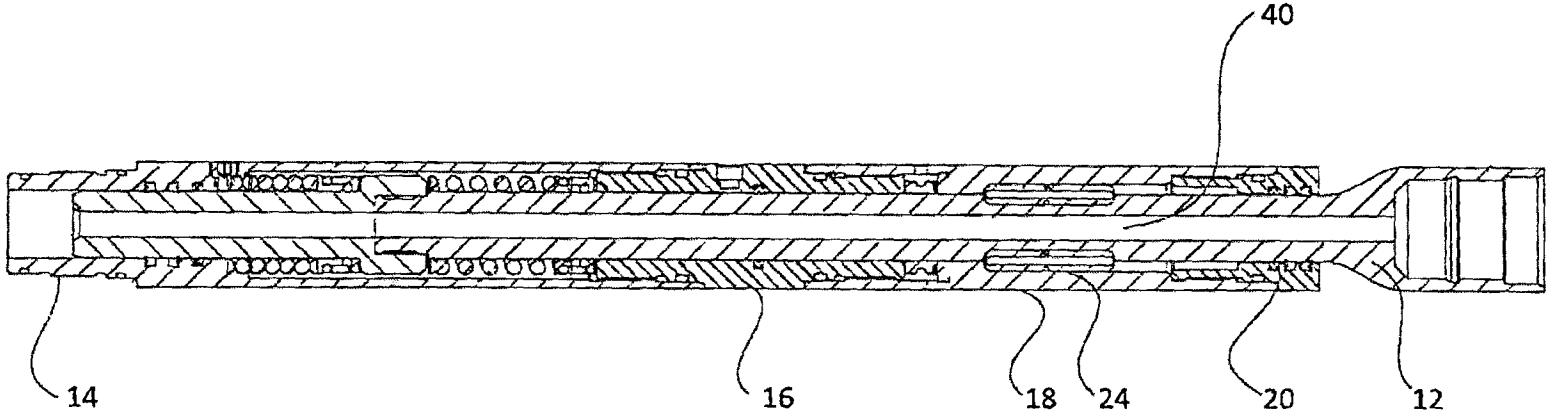
FIG. 6 is an assembled cross-sectional diagram of an axial and torsional force dampener in a fully-compressed position in accordance with one embodiment of the invention.
Figure 7:
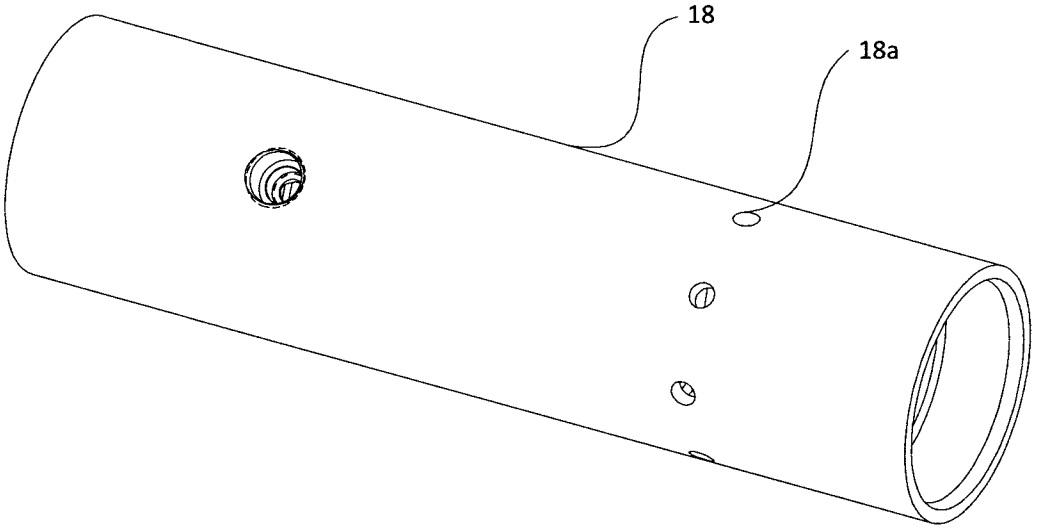
FIG. 7 is a perspective view of a pin housing of an axial and torsional force dampener in accordance with one embodiment of the invention.
Figure 8:
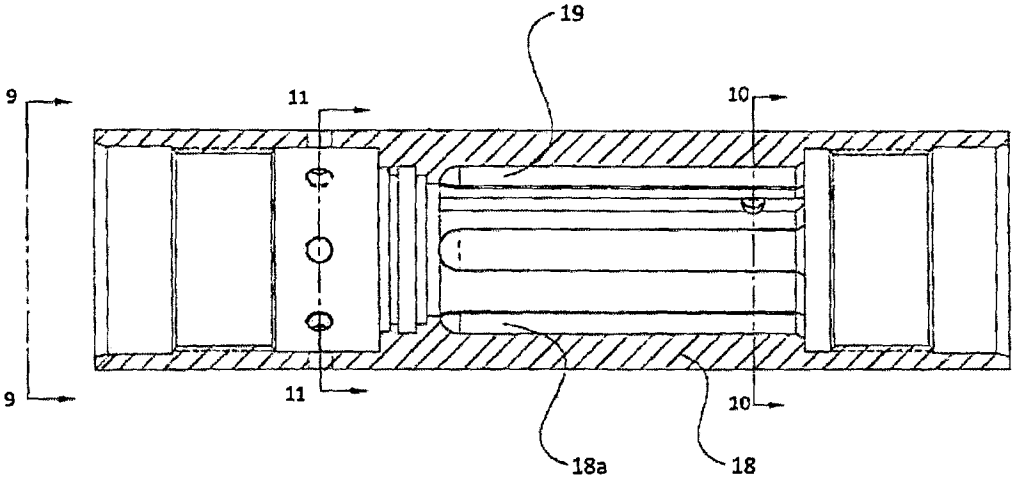
FIG. 8 is a cross-sectional view of a pin housing of an axial and torsional force dampener in accordance with one embodiment of the invention.
Figure 8A:
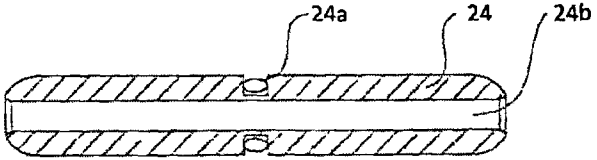
FIG. 8A is a cross-sectional view of a pin in accordance with one embodiment of the invention.

As shown in FIGS. 2-3 (side views) and FIGS. 4-6 (cross-sectional views), the ALTFD is moveable between a balanced position (FIG. 5) and a fully-compressed position (FIGS. 2 and 6) where during compression, the lower end shaft slides within the compression housing 14, mid-bulkhead 18 and pin housing 18 against spring 22*a*. With the release of a compression load, spring 22*a* returns the lower end shaft to the balanced position. Under axial tension, the ALTFD is moveable to a fully-extended position (FIG. 4) where the lower end shaft 12 slides within the compression housing 14, mid-bulkhead 16 and pin housing 18 against spring 22*b*. Upon release of a tension load, spring 22*b* returns the lower end shaft to the balanced position.

As shown in FIGS. 1 and 7-11, the pin housing 18 operatively contains a plurality of pins 24 that engage with the pin housing 18 and the lower end shaft 12 such that torsional force applied to the lower end shaft is transmitted through the pin housing 18, mid-bulkhead 16 and compression housing 14.

Importantly, each of the lower end shaft 12, compression housing 14, mid-bulkhead 16, pin housing 18 and bottom stopper 20 are generally cylindrical with each having an internal throughbore 40 such that fluids may flow between the ends of the ALTFD within the assembled structure.

Further details of the assembly and operation of the system is provided below.

Pin Housing

Figure 11:
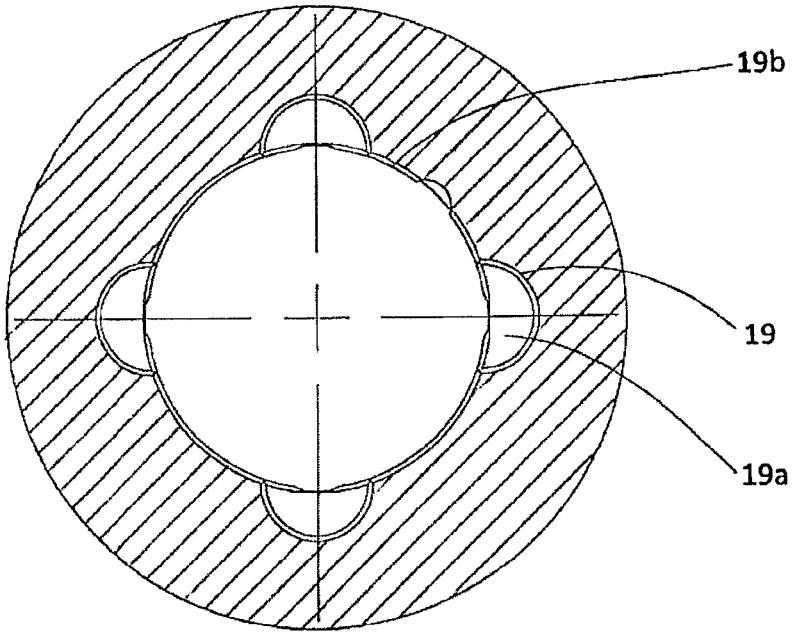
FIG. 11 is a cross-sectional view of a pin housing of an axial and torsional force dampener taken at line 11-11 of FIG. 8 in accordance with one embodiment of the invention.

As shown in FIGS. 7-11, the pin housing 18 operatively contains a pin housing sleeve 19 secured within the pin housing 18 by the bottom stopper 20. At its opposite end, the pin housing is secured to the mid-bulkhead 16. As best shown in FIG. 11, the pin housing sleeve 19 has a corrugated-shape cross-section that matingly engages within the pin housing 18. The pin housing sleeve 19 includes a plurality of pin slots 19*a* that engage with corresponding pins 24 as shown in FIGS. 1 and 4-6. Similarly, the bottom end shaft 12 includes corresponding recesses 12*a* that operatively contain pins 24.

In operation, the pins are simultaneously engaged within recesses 12*a* and pin slots 19*a* such that the pins 24 can slide within the pin slots.

Figure 9:
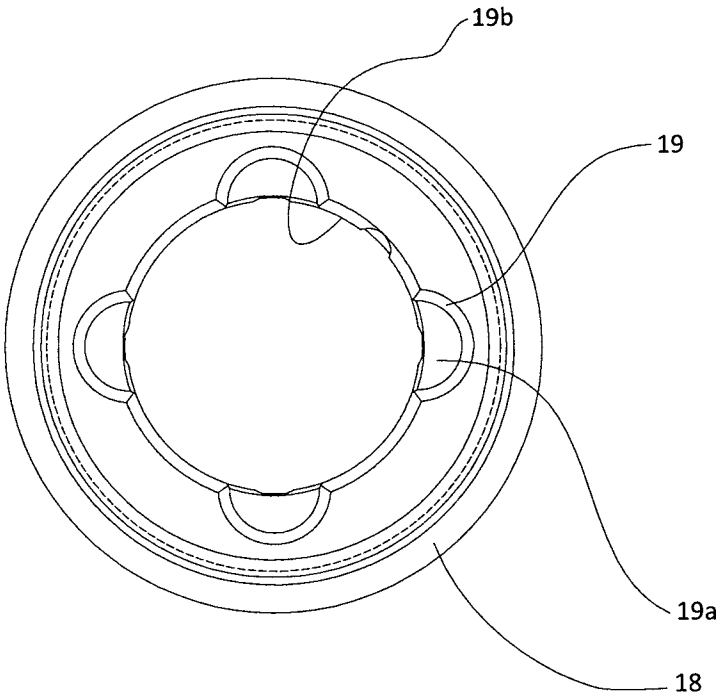
FIG. 9 is an end view of a pin housing of an axial and torsional force dampener in accordance with one embodiment of the invention.
Figure 10:
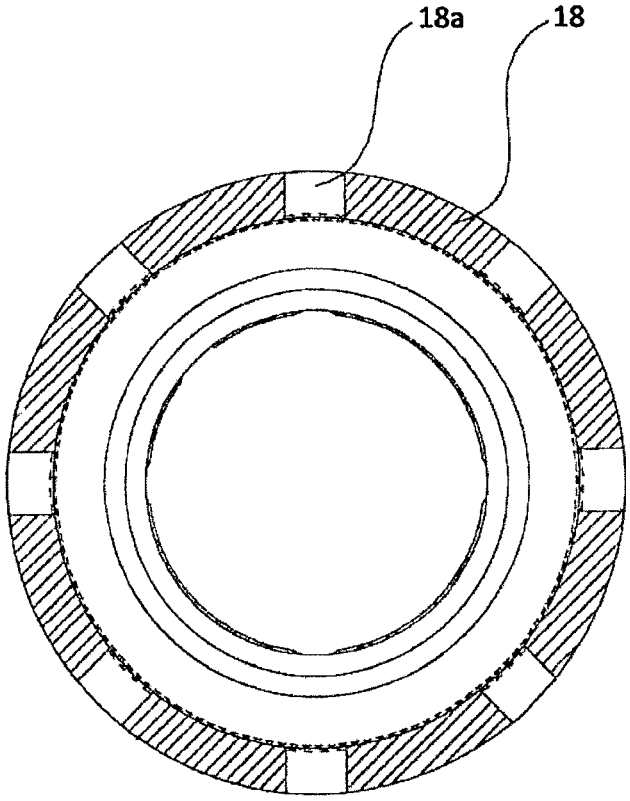
FIG. 10 is a cross-sectional view of a pin housing of an axial and torsional force dampener taken at line 10-10 of FIG. 8 in accordance with one embodiment of the invention.

As shown in FIGS. 9 and 11, the pin slots 19*a* are arranged within the pin housing sleeve 19 in pairs in diametrically opposed positions generally defining four points of a square. Between each pin slot 19*a*, the inner surface 19*b* of the pin housing sleeve is slightly concave and generally corresponds in curvature to outer diameter of the bottom end shaft 12. This configuration, where roughly half of the diameter of each pin 24 is retained in each of the pin slots 19 and recesses 12*a* allows the bottom end shaft 12 to move axially to absorb compressive forces but will not allow rotation of the bottom end shaft relative to the compression housing 14.

The pin housing sleeve 19 is press-fit within the pin housing and is preferably manufactured from high nitryl butyl rubber (HNBR) which assists in the overall torsional strength of the tool. That is, the HNBR rubber in contact with the pin chamber's inner housing provides a degree of torsional cushioning during rotation. In one embodiment, the pin housing sleeve 19 is steel.

In one embodiment, the pins are 2 inch long, nitrated 17-4 stainless rods having a 0.312 inch diameter. The torsional force limit is determined by the shear strength of the pins. Other materials such as Torlon may also be utilized. Preferably, each of the pins have a throughbore 24*b* to enable fluid pressure equalization during operation.

The pins may include one or more dampening devices 24*a* (such as a rubber o-ring) as a component of the pin structure to provide additional dampening between the pin and the pin housing.

It should be noted that while the anti-rotation components are described with four pins and corresponding slots, other pin arrangements may be utilized.

Figure 14:
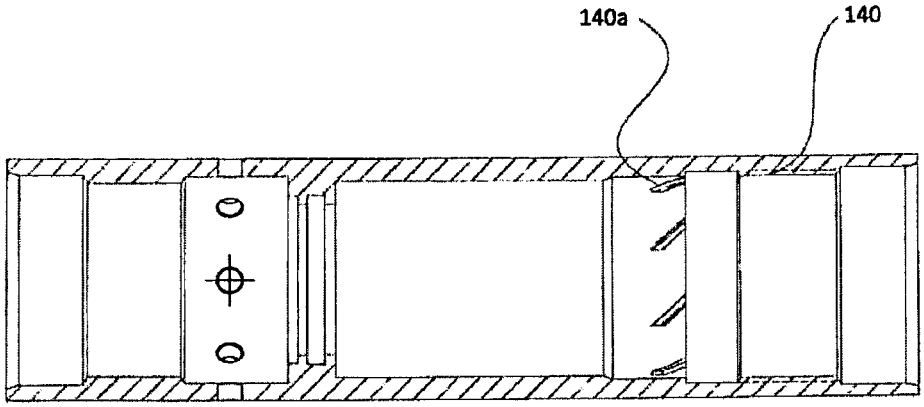
FIG. 14 is a cross-sectional view of an alternate pin housing (outer torsion housing) in accordance with one embodiment of the invention.
Figure 14A:
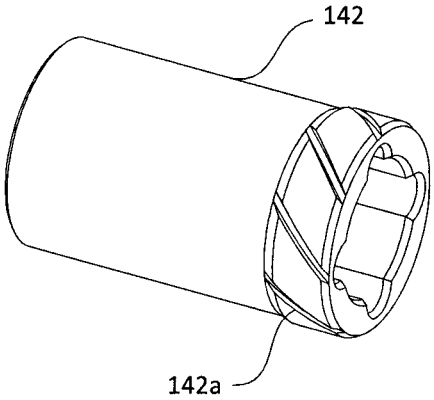
FIG. 14A is a perspective view of an inner torsion cartridge in accordance with one embodiment of the invention.
Figure 14B:
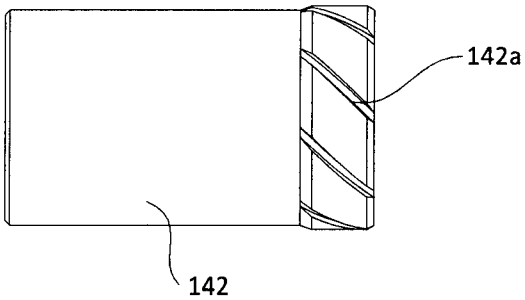
FIG. 14B is a side view of an inner torsion cartridge in accordance with one embodiment of the invention.
Figure 14C:
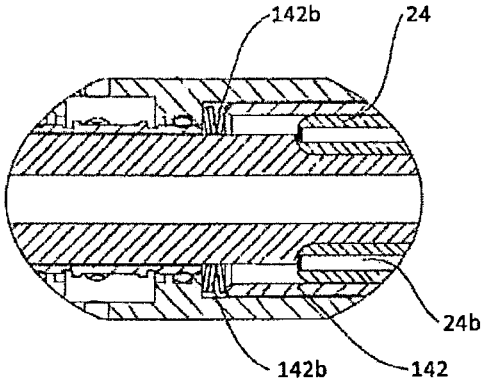
FIG. 14C is a cross-sectional view of a portion of an axial and torsional force dampener in accordance with one embodiment of the invention and showing details of the position of a disk spring relative to an inner torsion cartridge.

FIGS. 14A, 14B and 14C show an alternate embodiment of the pin housing that enables further dampening within the pin housing.

In this embodiment, the alternate pin housing 140 is adapted to receive a torsion cartridge 142 within the pin housing 140. The torsion cartridge 142 has an internal profile as described above and retains a pin housing sleeve 19 within this profile. Similarly, pins 40 are retained with this profile.

The torsion cartridge 142 includes a series of recesses 142*a* that engage with corresponding splines 140*a* within pin housing 140. As such, when the splines 142*a* and recesses 140*a* are engaged, torsional forces applied to the torsion cartridge will result in axial movement of the torsion cartridge 142 with respect to the pin housing.

Figure 14D:
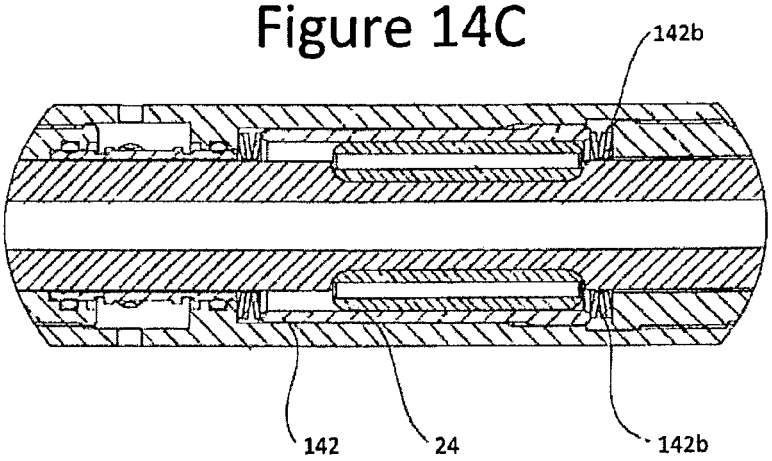
FIG. 14D is a cross-sectional view of a portion of an axial and torsional force dampener in accordance with one embodiment of the invention and showing details of the position of uphole and downhole disk springs relative to an inner torsion cartridge.

As shown in FIG. 14D, disk springs 142*b* are positioned at both ends of the torsion cartridge 142 such that the axial displacement of the torsion cartridge will act against these disk springs 142*b*. As such, high torsional forces being applied will be dampened by the axial movement of the torsion cartridge against these springs.

The torsion cartridge 142 is retained within the alternate pin housing by bottom end cap 20.

Force Dampening, Assembly and Other Design Features

Figure 1:
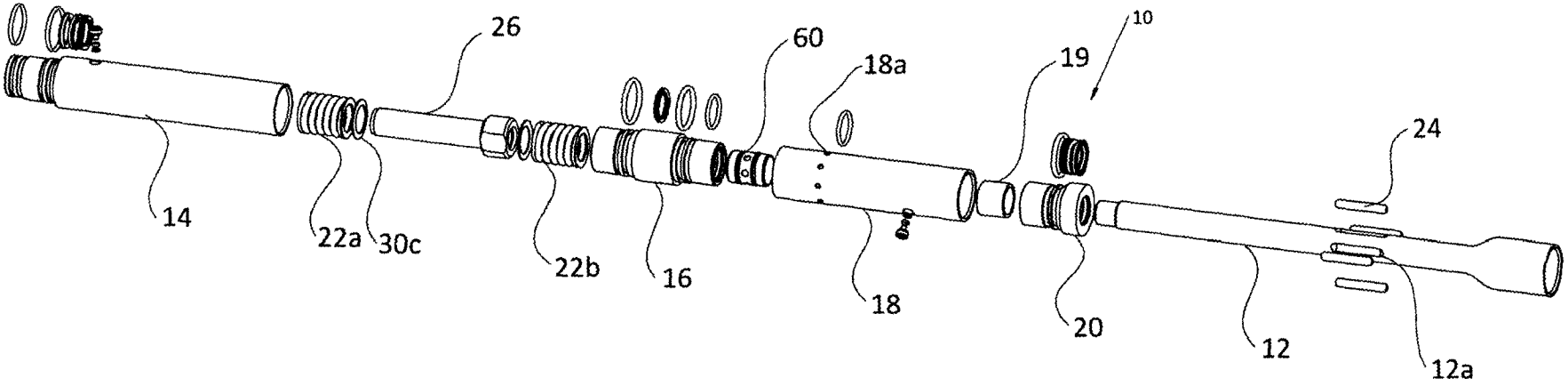
FIG. 1 is an exploded diagram of an axial and torsional force dampener in accordance one embodiment of the invention.

As best shown in FIG. 1 in the exploded view and in FIGS. 4-6, the ALTFD is assembled as a series of interlocking parts along the longitudinal axis of the tool that operatively provide the anti-torsional, lateral and axial force dampening functionalities, and allow for ease of assembly and disassembly for servicing each embodiment.

Axial force dampening is achieved through springs 22*a*, 22*b* which act to bias the ALTFD to its balanced position. As shown, spring 22*a* is seated over rod nut 26 within chamber 26*a* defined between the compression housing 14 and outer surface of the rod nut 26. As such, spring 22*a* is also seated against corresponding transverse surfaces 14*a*, 26*a* of the compression housing 14 and rod nut 26. The rod nut slides relative to the compression housing.

On the opposite side of the sliding cap seal 26, spring 22*b* is seated over bottom end shaft 12 within chamber 13 defined between the compression housing 14, bottom end shaft 12, mid-bulkhead 16 and rod nut 26. As shown, spring 22*b* is thereby seated against upper surface 26*b* of the rod nut 26 and lower surface 16*a* of the mid-bulkhead 16.

As such, the rod nut 26 prevents separation of the components under axial tension by the engagement of the rod nut 26 with the mid-bulkhead 16.

In addition, within each of the chambers 13 and 26*a*, hydraulic fluid is retained for enhanced dampening. Accordingly, appropriate seals are provided throughout the tool to contain the hydraulic fluid within the chambers while also sealing any high pressure fluids within the throughbore 40 of the ALTFD.

More specifically, a series of o-rings 30*a*, 30*b* within o-ring housings 30*c* and 30*d* provide seals to chambers 26*a* and 13.

In addition, o-rings 30*e* are provided to seal the rod nut 26 with respect to compression housing 14; o-rings 30*f* are provided to seal the mid-bulkhead 16 with respect to the bottom end shaft 12; o-rings 30*g* are provided to seal the mid-bulkhead 16 with respect to the compression housing 14; o-ring 30*h* is provided to seal the pin housing 18 with respect to the bottom end shaft 12; o-ring 30*i* is provided to seal the pin housing 18 with respect to the bottom stopper 20; o-rings 30*j* are provided to seal the bottom stopper 20 with respect to the bottom end shaft 12; o-rings 30*k* are provided to seal the compression housing 14 to the drillstring; and o-ring 30*l* is provided to seal the pin housing 18 with respect to the mid-bulkhead 16.

Preferred o-rings include Viton™ Polypac™ and Polymite™.

The chambers are filled through respective oil fill ports 45*a*, 45*b*.

Dampening

Springs 22*a*, 22*b* and pillow blocks 30*c*, 30*d* provide axial dampening. The springs are preferably designed to be utilized at 50% of their technical limit for free height retention and maximum life cycles. Generally, the springs are a consumable component within the tool with it being estimated that they will require replacement at around 750 hours of usage. The harmonic frequency of the ALTFD is estimated to be approximately 4.8 Hz which is well below the operating frequency of drillstring agitation devices which are typically 16-26 Hz. The outer surfaces of the springs 22*a*, 22*b* may also be provided with bonded rubber to provide further dampening and to provide a travel limiter as the springs compress.

The pillow blocks 30*c*, 30*d* absorb the low end harmonic vibration that is transmitted axially through the tool and augment the performance of the springs which are designed to absorb the higher G impact events or agitation. The pillow block design allows for extrusion of the internal o-ring elements in order to create absorption. Depending on usage, it is recommended to replace o-rings at every service or 500 hours at a maximum.

Pressure Compensation

Figure 12:
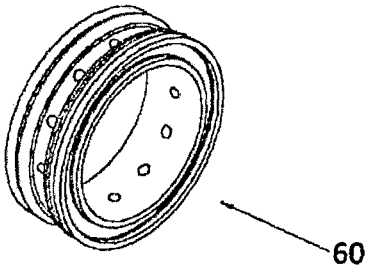
FIG. 12 is a perspective view of a pressure compensation membrane support in accordance with one embodiment of the invention.
Figure 12A:
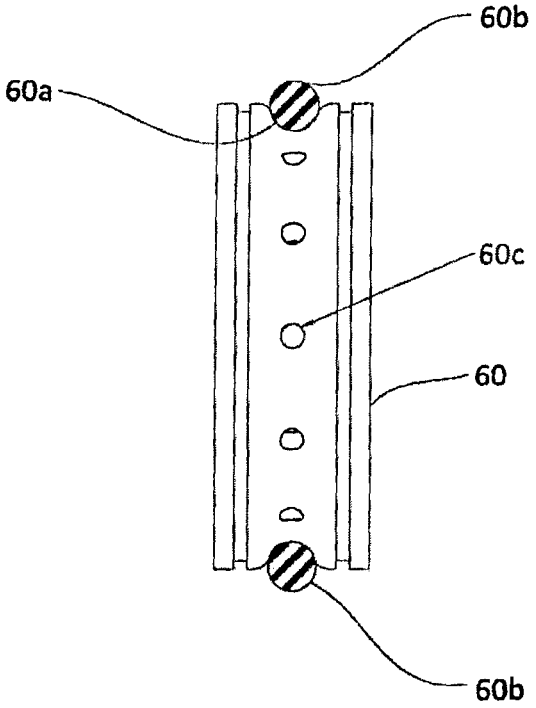
FIG. 12A is a side view of a pressure compensation membrane support in accordance with one embodiment of the invention.

Telescopic compression and extension occurs with both ends of the shaft exposed to the external environment, so that there is always a constant volume of the shaft internally. Thus, as the ALTFD moves, there is no volume change internally and no volume compensation is required. In a preferred embodiment, and as shown in FIGS. 12 and 12A, the pin housing may include a pressure compensation membrane support (PCMS) 60 and o-ring 60*b* seated against surface 60*a*. The PCMS 60 and o-ring 60*b* enable pressure to balance between the interior and exterior of the ALTFD. That is, as shown in FIGS. 1 and 4, the pin housing includes a plurality of holes 18*a* allowing exterior fluids to enter the pin housing 18 adjacent the PCMS. Exterior fluids pressurize against o-ring 60*b* which then partially extrudes into holes 60*c* which then provides an equalizing force to the interior of the ALTFD. Pressure compensation greatly increases seal life and decreases the force the seal exerts on the shaft which allows for freer travel of shaft while also enhancing dampening.

Testing

The system was lab tested on simulation apparatus capable of inducing high vibration and shock G-forces to the tool. A first simulation apparatus was capable of inducing 8 G's of vibration and 40 G's of shock to one end of the tool and allowing measurement of vibration and shock loading at the opposite end of the tool. A second simulation device was also utilized that induced 40 G's of vibration and 160 G's of shock.

Testing showed that the tool was capable of reducing the vibration to 0.75 G's and the shock to 4.5 G's from 8 G's of vibration and 40 G's of shock with the first simulation device. With the second simulation device, the ALTFD was able to reduce 40 G's of vibration to 6 G's and 160 g's of shock to 25 g's of shock. These tests were conducted with 4 probes in a horizontal geometry, and over 23 simulations were conducted at timed intervals. During testing, the ATLFD had onboard G measuring and recording devices that enabled data to be downloaded and graphed following each test.

From lab testing, it was also determined that it requires 40 G's of vibration and 160 G's of shock in order to cause the ALTFD to travel to the fully extended or compressed positions. These forces are catastrophic energy levels, and even though the ALTFD is capable of dampening to this level, and attached probes will be protected, generally it is understood that the drillstring and other components external to the probe would likely fail at these energy levels.

Although the present invention has been described and illustrated with respect to preferred embodiments and preferred uses thereof, it is not to be so limited since modifications and changes can be made therein which are within the full, intended scope of the invention as understood by those skilled in the art.

The invention claimed is:

1. A downhole assembly for configuration to a drill string, the downhole assembly comprising:

a drill string component;

sensor equipment; and a downhole tool having:

a bottom end shaft;

a torsional housing;

a compression housing;

wherein:

the sensor equipment is connected to the drill string component via the downhole tool;

the downhole tool and sensor equipment are housed inside the drill string component to allow movement of the sensor equipment inside the drill string component without affecting the overall length of the drill string;

the bottom end shaft of the downhole tool is connected to an interior of the drill string component and is telescopically engaged within the compression housing and the torsional housing;

the torsional housing has at least one longitudinal slot operatively containing at least one pin for sliding engagement within a corresponding longitudinal slot and engagement within a recess on the bottom end shaft, wherein engagement of the at least one pin within the corresponding longitudinal slot allows axial movement of the bottom end shaft relative to the torsional housing to dampen axial and torsional forces on the sensor equipment, and prevents rotational movement of the bottom end shaft relative to the torsional housing; and the compression housing is connected to the sensor equipment in the interior of the drill string component, the compression housing operatively containing a first spring between the compression housing and the bottom end shaft, the first spring for absorbing compression forces between the bottom end shaft and the compression housing for dampening compression forces on the sensor equipment.

2. The downhole assembly as in claim 1 further comprising a second spring operatively contained within the compression housing between the compression housing and the bottom end shaft, the second spring for absorbing tension forces between the bottom end shaft and the compression housing for dampening tension forces on the sensor equipment, and wherein when under no compressive or tensile forces the first and second springs return the bottom end shaft to a balanced position.

3. The downhole assembly as in claim 1 wherein the torsional housing operatively retains four pins.

4. The downhole assembly as in claim 2 wherein the first and second springs are contained within first and second hydraulic chambers containing hydraulic fluid to provide further dampening, the hydraulic fluid sealed within the chambers from drilling fluid located in a throughbore of the tool.

5. The downhole assembly as in claim 1 wherein the torsional housing includes a rubber sleeve configured to inner surfaces of the torsional housing for providing torsional force dampening, wherein the at least one pin engages with the rubber sleeve.

6. The downhole assembly as in claim 1 further comprising a first seal operatively connected between the torsional housing and bottom end shaft.

7. The downhole assembly as in claim 6 further comprising a second seal operatively connected between the compression housing and bottom end shaft.

8. The downhole assembly as in claim 7 further comprising a pressure compensation system for equalizing pressure between the exterior of the tool and the first and second seals.

9. The downhole assembly as in claim 8 wherein the pressure compensation system includes a pressure ring operatively positioned between the first and second seals having an internal diameter generally corresponding to the external diameter of the bottom end shaft, the pressure ring having at least one hole extending between an internal and external surface of the pressure ring and wherein the external surface operatively retains a pressure ring seal.

10. The downhole assembly as in claim 1 wherein the first and second springs are rubber-coated to provide further dampening.

11. A downhole assembly as in claim 1, wherein:

the torsional housing comprises an outer torsion housing and an inner torsion cartridge having mating splines and recesses enabling helical and axial movement of the inner torsion cartridge relative to the outer torsion housing when the inner torsion cartridge is subjected to a torsional force relative to the outer torsion housing; the inner torsion cartridge comprising the at least one longitudinal slot operatively containing the at least one pin.

12. The downhole assembly as in claim 11 further comprising a disk spring seated against downhole and uphole surfaces of the inner torsion cartridge for absorbing axial uphole and downhole forces when the inner torsion cartridge moves relative to the outer torsion housing.

13. The downhole assembly as in claim 11 further comprising a second spring operatively contained within the compression housing between the compression housing and the bottom end shaft, the second spring for absorbing tension forces between the bottom end shaft and the compression housing and wherein when under no compressive or tensile forces the first and second springs return the bottom end shaft to a balanced position.

14. The downhole assembly as in claim 11 wherein the first and second springs are contained within first and second hydraulic chambers containing hydraulic fluid.

15. The downhole assembly as in claim 11 further comprising a first seal operatively connected between the torsional housing and bottom end shaft.

16. The downhole assembly as in claim 15 further comprising a second seal operatively connected between the compression housing and bottom end shaft.

17. The downhole tool as in claim 16 further comprising a pressure compensation system for equalizing pressure between the exterior of the tool and the first and second seals.

18. The downhole assembly as in claim 17 wherein the pressure compensation system includes a pressure ring operatively positioned between the first and second seals having an internal diameter generally corresponding to the external diameter of the bottom end shaft, the pressure ring having at least one hole extending between an internal and external surface of the pressure ring and wherein the external surface operatively retains a pressure ring seal.

19. The downhole assembly as in claim 11 wherein the first and second springs are rubber-coated.

20. The downhole assembly as in claim 11 wherein the inner torsion cartridge operatively retains four pins.

21. The downhole assembly as in claim 1, wherein:

a first seal is operatively connected between the torsional housing and bottom end shaft;

a second seal is operatively connected between the compression housing and bottom end shaft;

the torsional housing includes a rubber insert configured to inner surfaces of the torsional housing and wherein the at least one pin engages with the rubber insert;

the compression housing operatively contains:

the first spring contained within a first hydraulic chamber containing hydraulic fluid between the compression housing and the bottom end shaft, the first spring for absorbing compression forces between the bottom end shaft and the compression housing; and a second spring contained within a second hydraulic chamber containing hydraulic fluid between the compression housing and the bottom end shaft, the second spring for absorbing tension forces between the bottom end shaft and the compression housing;

wherein when under no compressive or tensile forces the first and second springs return the bottom end shaft to a balanced position.

22. The downhole assembly of claim 21 further comprising a pressure compensation system for equalizing pressure between the exterior of the tool and the first and second seals, the pressure compensation system including a pressure ring operatively positioned between the first and second seals having an internal diameter corresponding to the external diameter of the bottom end shaft, the pressure ring having at least one hole extending between an internal and external surface of the pressure ring and wherein the external surface operatively retains a pressure ring seal.

23. The downhole assembly as in claim 1 wherein:

a first seal is operatively connected between the torsional housing and bottom end shaft;

a second seal is operatively connected between the compression housing and bottom end shaft;

the torsional housing comprises an outer torsion housing and an inner torsion cartridge have mating splines and recesses enabling helical and axial movement of the inner torsion cartridge relative to the outer torsion housing when the inner torsion cartridge is subjected to a torsional force relative to the outer torsion housing; the inner torsion cartridge comprising:

the at least one longitudinal slot operatively containing the at least one pin; and a disk spring seated against downhole and uphole surfaces of the inner torsion cartridge for absorbing axial uphole and downhole forces when the inner torsion cartridge moves relative to the outer torsion housing; and wherein the compression housing operatively contains:

a first spring contained within a first hydraulic chamber containing hydraulic fluid between the compression housing and the bottom end shaft, the first spring for absorbing compression forces between the bottom end shaft and the compression housing; and a second spring contained within a second hydraulic chamber containing hydraulic fluid between the compression housing and the bottom end shaft, the second spring for absorbing tension forces between the bottom end shaft and the compression housing;

wherein when under no compressive or tensile forces the first and second springs return the bottom end shaft to a balanced position.

24. The downhole assembly of claim 23 further comprising a pressure compensation system for equalizing pressure between the exterior of the tool and the first and second seals, the pressure compensation system including a pressure ring operatively positioned between the first and second seals having an internal diameter corresponding to the external diameter of the bottom end shaft, the pressure ring having at least one hole extending between an internal and external surface of the pressure ring and wherein the external surface operatively retains a pressure ring seal.

* * * * *